US006883612B2

(12) United States Patent
Ferguson et al.

(10) Patent No.: US 6,883,612 B2
(45) Date of Patent: Apr. 26, 2005

(54) ROD PUMP

(75) Inventors: Joel Ferguson, Longview, TX (US); Doug Verner, Gladewater, TX (US); Brian Waterhouse, Leduc (CA)

(73) Assignee: Weatherford/Lamb, Inc., Houston, TX (US)

( * ) Notice: Subject to any disclaimer, the term of this patent is extended or adjusted under 35 U.S.C. 154(b) by 6 days.

(21) Appl. No.: 10/347,132

(22) Filed: Jan. 17, 2003

(65) Prior Publication Data

US 2004/0140087 A1 Jul. 22, 2004

(51) Int. Cl.[7] ..... E21B 43/00
(52) U.S. Cl. ..... 166/369; 166/68.5; 166/105
(58) Field of Search ..... 166/68, 68.5, 72, 166/73, 105, 107, 369

(56) References Cited

U.S. PATENT DOCUMENTS 4,921,407 A * 5/1990 Ponder ..... 417/553
5,372,197 A * 12/1994 Wacker ..... 166/311
5,941,311 A * 8/1999 Newton ..... 166/369
2002/0197174 A1 * 12/2002 Howard ..... 417/417

FOREIGN PATENT DOCUMENTS

CA 1334733 3/1995 ..... F04B/47/00

* cited by examiner

*Primary Examiner*—William Neuder
(74) *Attorney, Agent, or Firm*—Moser, Patterson & Sheridan, L.L.P.

(57) ABSTRACT

A rod pump for use in a wellbore is provided. In one embodiment, the rod pump comprises a traveling valve cage attachable to a rod string, the traveling valve cage having a first latch component operatively connected thereto; and a pump housing having a second latch component operatively connected thereto, wherein the first latch component is disposable in latching engagement with the second latch component. The first latch component comprises a surface having a set of grooves, and the second latch component comprises one or more pins.

43 Claims, 7 Drawing Sheets

ROD PUMP

BACKGROUND OF THE INVENTION

1. Field of the Invention

This invention relates to pumping apparatus for transporting fluids from a well formation to the earth's surface. More particularly, embodiments of the invention pertain to a rod pump which can be pulled in a collapsed position.

2. Description of the Related Art

Many hydrocarbon wells are unable to produce at commercially viable levels without assistance in lifting formation fluids to the earth's surface. In some instances, high fluid viscosity inhibits fluid flow to the surface. More commonly, formation pressure is inadequate to drive fluids upward in the wellbore. In the case of deeper wells, extraordinary hydrostatic head acts downwardly against the formation, thereby inhibiting the unassisted flow of production fluid to the surface.

A common approach for urging production fluids to the surface includes the use of a mechanically actuated, positive displacement pump. Mechanically actuated pumps are sometimes referred to as "sucker rod" pumps because of the reciprocal movement of the pump necessary for positive displacement is induced through reciprocal movement of a string of sucker rods above the pump from the surface.

A sucker rod pumping installation consists of a positive displacement pump disposed within the lower portion of the production tubing. The installation includes a piston which is moved in linear translation within the tubing by means of steel or fiberglass sucker rods. Linear movement of the sucker rods is typically imparted from the surface by a rocker-type structure. The rocker-type structure serves to alternately raise and lower the sucker rods, thereby imparting reciprocating movement to the piston within the pump downhole.

When a rod pump is in need of repair or replacement, a lubricator and a rig may be required to pull the rod pump from the production tubing. Typically, a rod pump is pulled in an extended position (i.e., the pump is in an upstroke position and at maximum length) which may require equipment other than commonly available lubricator lengths and rigs. Thus, delays in repairs and service may result because of the unavailability of necessary equipment. These delays results in costly down time and loss of production. Also, long lubricators become a safety concern because it is difficult to support long (tall) lubricators.

Therefore, there is a need for a rod pump which can be pulled in a collapsed position which reduces or minimizes the length of the rod pump and reduces the length of the lubricator required to remove the rod pump from the production tubing.

SUMMARY OF THE INVENTION

A rod pump for use in a wellbore is provided. The rod pump can be pulled in a collapsed position which reduces and/or minimizes the length of the rod pump and reduces the length of the lubricator required to remove the rod pump from the production tubing. In one embodiment, the rod pump comprises a traveling valve cage attachable to a rod string, the traveling valve cage having a first latch component operatively connected thereto; and a pump housing having a second latch component operatively connected thereto, wherein the first latch component is disposable in latching engagement with the second latch component. The first latch component comprises a surface having a set of grooves, and the second latch component comprises one or more pins.

Another embodiment provides a reciprocating lift system comprising: a surface pumping unit; a rod string disposed in connection with the surface pumping unit; and a pump disposed in connection with the rod string, wherein the pump comprises a traveling valve cage attachable to a rod string, the traveling valve cage having a first latch component operatively connected thereto; and a pump housing having a second latch component operatively connected thereto, wherein the first latch component is disposable in latching engagement with the second latch component.

Another embodiment provides a latch assembly for a rod pump, comprising: a first latch component operatively connected to a traveling valve of the rod pump; and a second latch component operatively connected to a pump housing of the rod pump, wherein the first latch component is disposable in latching engagement with the second latch component. The pump housing may include a bushing having the second latch component, and the first latch component may be disposed on a plug connected to the traveling valve cage. In another embodiment, the first latch component is disposable in releasable engagement with the second latch component. In yet another embodiment, the first latch component comprises a collet, and the second latch component comprises a collet latch.

Another embodiment provides pump for lifting fluids from a wellbore comprising: a movable portion being movable in relation to a stationary portion, the movable portion having a first latch member and the stationary portion having a second latch member, wherein the first latch member disposable in engagement with the second latch member to limit relative movement between the movable portion and the stationary portion. The movable portion may comprise a traveling valve cage or a plug connected to the traveling valve cage. The stationary portion may comprise a pump housing or a bushing connected to the pump housing.

BRIEF DESCRIPTION OF THE DRAWINGS

So that the manner in which the above recited features of the present invention are attained and can be understood in detail, a more particular description of the invention, briefly summarized above, may be had by reference to the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
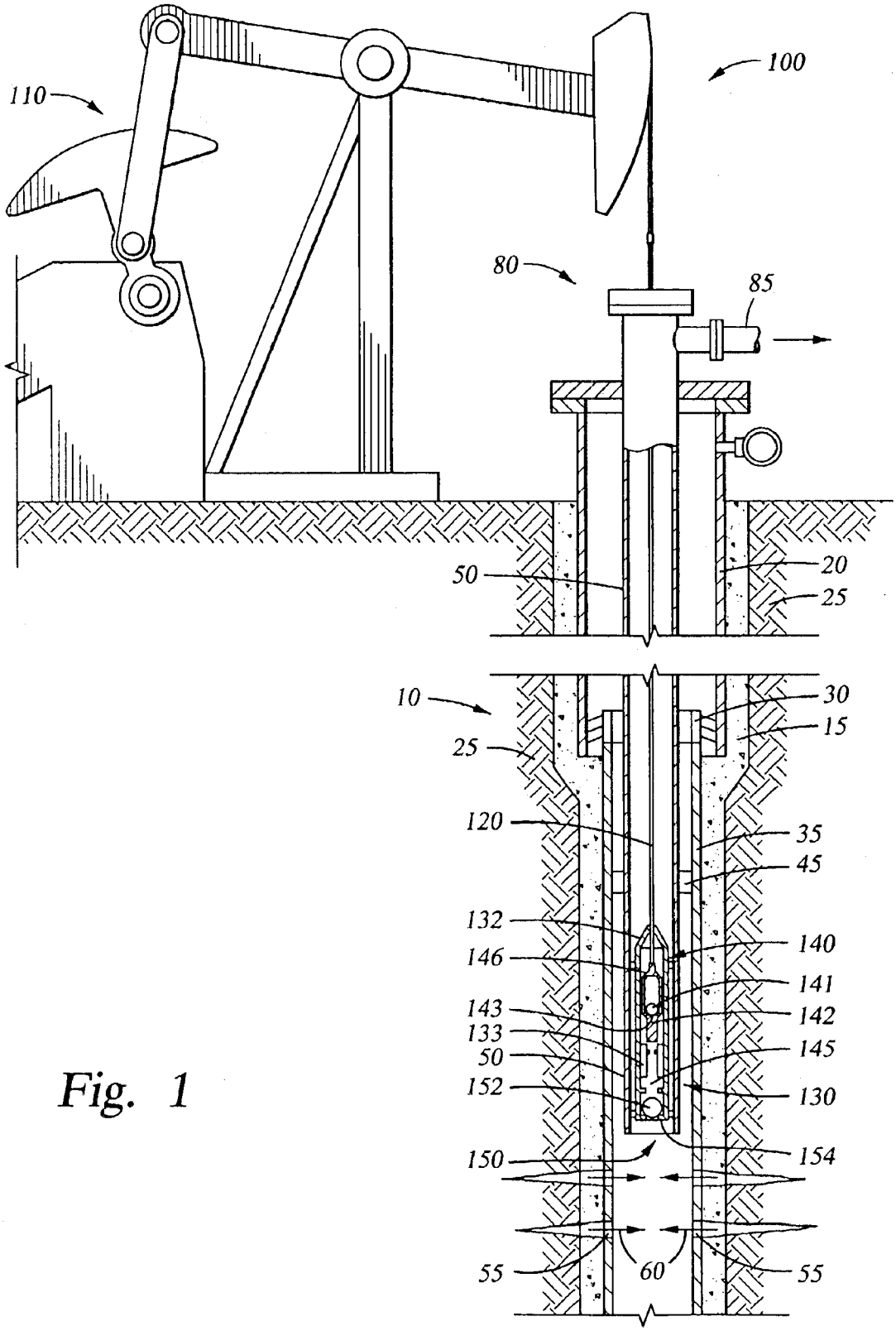
FIG. 1 is a cross-sectional view of a wellbore having one embodiment of a reciprocating rod lift system of the invention.

FIG. 1 is a cross-sectional view of a wellbore 10 having one embodiment of a reciprocating rod lift system 100. As shown in FIG. 1, the wellbore 10 has been completed and includes a first string of surface casing 20 hung from the surface. The first string of surface casing 20 is fixed in a formation 25 by cured cement 15. A second string of casing 35 is also shown in FIG. 1. The second string of casing 35, sometimes referred to as a "liner," is hung from the surface casing 20 by a conventional liner hanger 30. The liner hanger 30 employs slips which engage the inner surface of the surface casing 20 to form a frictional connection. The second string of casing 35 (also referred herein as liner 35) is also cemented in the wellbore 10 after being hung from the surface casing 20.

The wellbore 10 is shown in a state of production. The liner 35 includes a plurality of perforations 55 to provide fluid communication between the wellbore 10 and a producing zone in the formation 25. The flow of hydrocarbons into the wellbore 10 and through the perforations 55 are depicted by arrows 60.

A string of production tubing 50 is also shown FIG. 1. The production tubing 50 provides a path for hydrocarbons to travel to the surface. One or more packers 45 may be positioned within the production tubing 50 to seal an annular region between the production tubing 50 and the liner 35. The term "tubing" or "production tubing" herein includes not only joints of tubing, but any tubular body nested within the casing string through which production fluids travel en route to the surface. At the surface, a wellhead 80 receives production fluids and diverts them through a flow line 85. Formation fluids are then separated, treated and refined for commercial use. It is understood that various components of a conventional wellhead and separator facilities are not shown in FIG. 1.

As shown in FIG. 1, a reciprocating rod lift system 100 is disposed in association with the wellbore 10. The reciprocating rod lift system 100 includes a surface pumping unit 110, a rod string 120 and a positive displacement pump 130. The surface pumping unit 110 is connected to provide a reciprocating motion to the rod string 120. In one embodiment, the surface pumping unit 110 is powered by an electric or gas prime mover and includes a connection cable which connects to a top portion of the rod string 120. The rod string 120 may include a plurality of segments connected in sequence and disposed within the production tubing 50. The positive displacement pump 130 is disposed at a terminal portion of the rod string 120 and positioned into a pump seating nipple near the producing zone and the perforations 55 on the casing 35.

In one embodiment, the positive displacement pump 130 comprises a rod pump which includes a pump housing 132, a traveling valve 140 and a standing valve 150. The traveling valve 140 and the standing valve 150 are disposed within the pump housing 132 (also referred herein as the barrel tube). The traveling valve 140 comprises a ball check valve and is disposed in a traveling valve cage 146 which is attached to a terminal portion of the rod string 120. The traveling valve cage 146 is movable within the pump housing 132 by the reciprocating motions provided through the rod string 120. The standing valve 150 is disposed securely against the barrel tube of the rod pump or barrel tube bushing and comprises a standing ball check valve. In one embodiment, the traveling valve 140 is a check valve (i.e., one-way valve) comprising a ball 141 and seat 143. Similarly, the standing valve 150 is a check valve comprising a ball 152 and seat 154. However, the present invention contemplates utilizing other types of valves.

Fluid is brought to the surface by the reciprocating pumping action of the surface pumping unit 110 attached to the rod string 120, which in turn, moves the traveling valve 140. The volume between the standing valve 150 and the upper traveling valve 140 defines a pump chamber 145. The pump chamber 145 serves as a path of fluid transfer during the pumping operation. In operation, the rod string 120 imparts a reciprocating upstroke and down stroke to the traveling valve 140. During the upstroke, the traveling valve 140 is closed. In this respect, the upper ball 141 is seated upon the upper seat 143. Movement of the closed traveling valve 140 upward creates a vacuum within the pump chamber 145. This, in turn, causes the standing valve 150 to unseat so that the lower ball 152 lifts off of the lower seat 154. Production fluids are then drawn upward into the chamber 145.

On the down stroke, the standing valve 150 closes, and the standing ball 152 seats upon the lower seat 154, primarily with the aid of gravity. At the same time, the traveling valve 140 opens to pass through fluids previously residing in the chamber 145. Fluids are delivered by positive displacement through the traveling valve 140 and up the wellbore 10 through the tubing 50. The upstroke and down stroke cycles are repeated, causing fluids to be lifted upward through the wellbore 10 and, ultimately, to the earth's surface.

Figure 2:
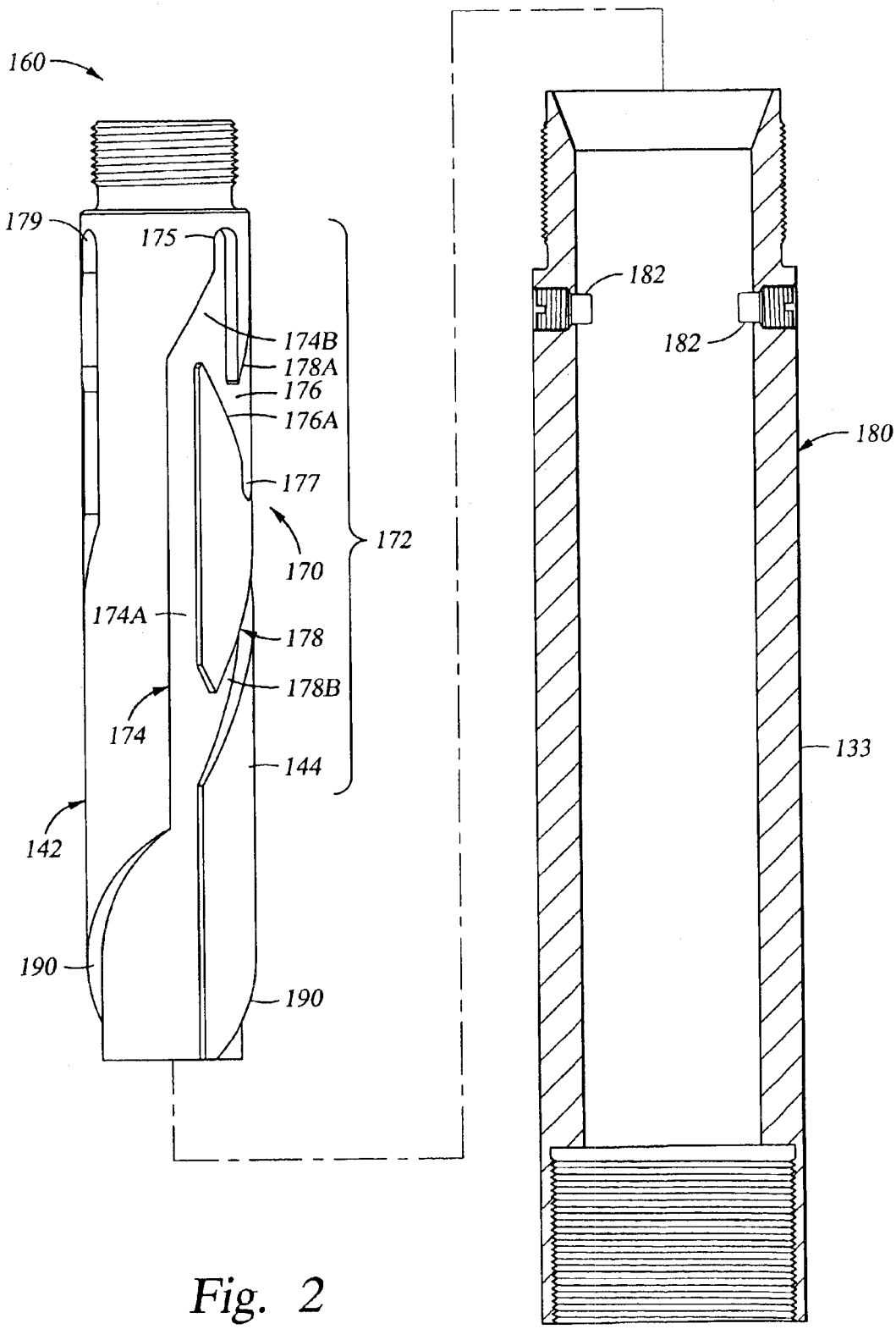
FIG. 2 is a partially cross sectional side view of one embodiment of a latch assembly for selectively latching and unlatching a traveling valve cage to a pump housing.

In one embodiment, the positive displacement pump 130 includes a latch assembly 160 for selectively latching and unlatching the traveling valve cage 146 in a contracted position (i.e., down stroke position). The traveling valve cage 146 may be latched to the pump housing 132 or a bushing 133 disposed in the pump housing 132 of the positive displacement pump 130. FIG. 2 is a partially cross sectional side view of one embodiment of a latch assembly 160 for selectively latching and unlatching a traveling valve cage to a pump housing. The latch assembly 160 comprises a first latch component 170 disposed on a terminal portion of the traveling valve cage 146 and a second latch component 180 disposed on the positive displacement pump barrel tube or pump housing 132. The first latch component 170 is disposed in releasable engagement with the second latch component 180. In one embodiment, the first latch component 170 comprises one or more sets of grooves 172 disposed on an outer surface 144 of a plug 142 which is disposed at the terminal portion of the traveling valve cage 146, and the second latch component 180 comprises one or more pins 182 disposed on a bushing 133 disposed in the pump housing 132 (or on an interior surface of the pump housing 132). Alternatively, the first latch component comprises one or more pins disposed on the traveling valve cage 146, and the second latch component comprises an interior surface of the pump housing 132 having a set of grooves. The sets of grooves 172 defines a plurality of surfaces which guide the relative movement of the traveling valve cage 146 against the one or more pins 182 disposed on the pump housing 132. The sets of grooves 172 also include a plurality of stops which indicates the relative position of the traveling valve cage 146 with respect to the pump housing 132, which enables an operator to latch and unlatch the traveling valve cage 146 with respect to the pump housing 132.

In one embodiment, each set of grooves 172 defines an entry groove 174, a locking groove 176 and a release groove 178. The plug 142 of the traveling valve cage 146 further includes one or more cut-lip guides 190. Each cut-lip guide 190 extends from a terminal portion of the plug 142 to an entry groove 174. The cut-lip guides 190 facilitate rotation of the traveling valve cage 146 and guide the pins 182 into the entry groove 174 as the traveling valve cage 146 is lowered. The entry groove 174 includes a first portion 174A which is substantially parallel to an axis of the plunger 140 and a first upper slanted portion 174B extending to a first upper stop 175. The first upper stop 175 is utilized to indicate to an operator that the first latch component 170 on the traveling valve cage 146 has engaged the second latch component 180 on the pump housing 132. The locking groove 176 includes a first slanted catch surface 176A extending to a locking stop 177. The slanted catch surface 176A is disposed below the first upper stop 175 to guide the pins 182 into the locking stop 177 as the traveling valve cage 146 is raised or lifted. The locking stop 177 is utilized to indicate to an operator that the traveling valve cage 146 is latched onto the pins 182 on the pump housing 132 and that the rod pump is ready to be retrieved in a contracted position.

The release groove 178 is utilized to release the traveling valve cage 146 from the pins 182 on the pump housing 132. The release groove 178 includes a second upper slanted surface 178A extending to a second upper stop 179 and an exit portion 178B connecting from the second stop 179 to the entry groove 174. The second upper slanted surface 178A is disposed above the locking stop 177 to guide the pins 182 into the second upper stop 179 as the traveling valve cage 146 is raised or lifted. The second upper stop 179 is utilized to indicate to an operator that the traveling valve cage 146 is in position to be raised to release (or unlatch) the pins 182 on the pump housing 132. The exit portion 178B guides the pins 182 out of the set of grooves 172 as the traveling valve cage 146 is lifted.

Figure 3A:
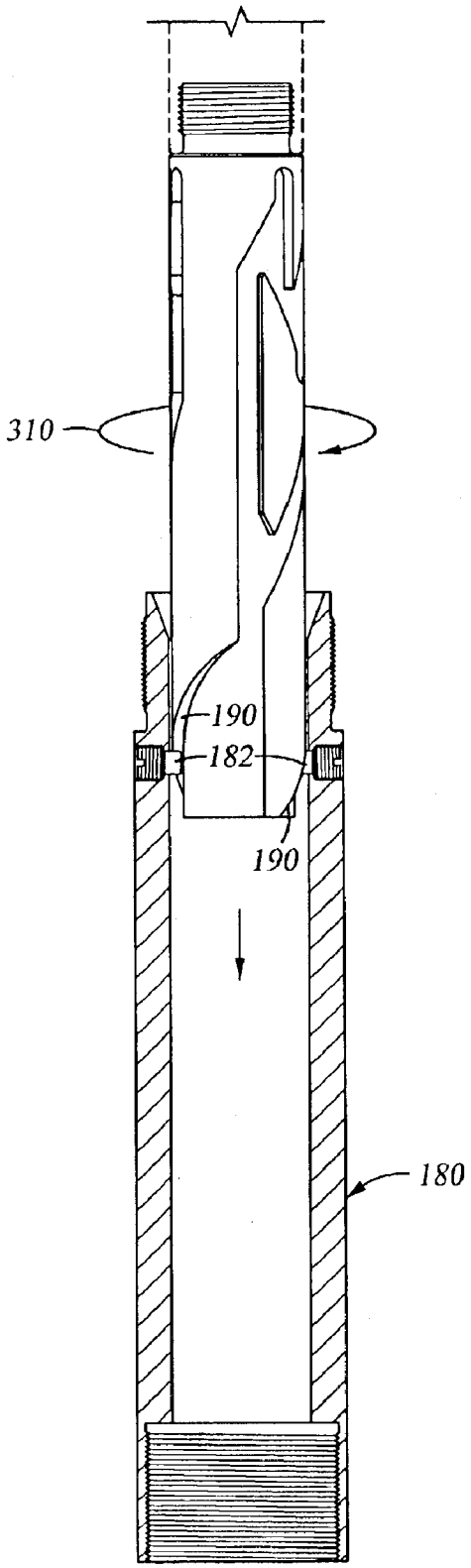
FIGS. 3A–F are partially cross sectional side views of one embodiment of a latch assembly illustrating latching and unlatching operations.
Figure 3B:
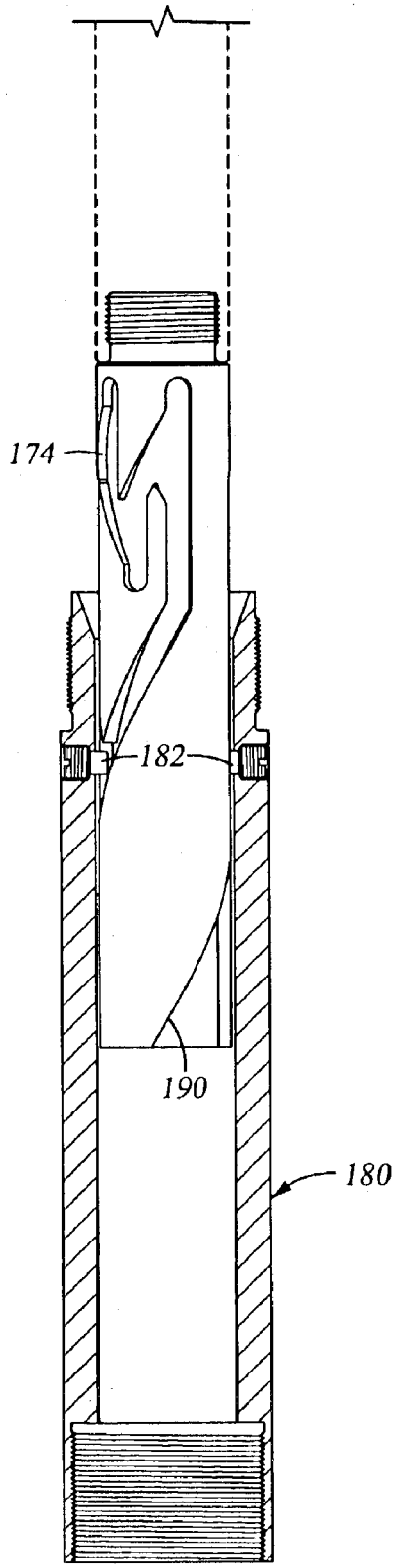
Figure 3C:
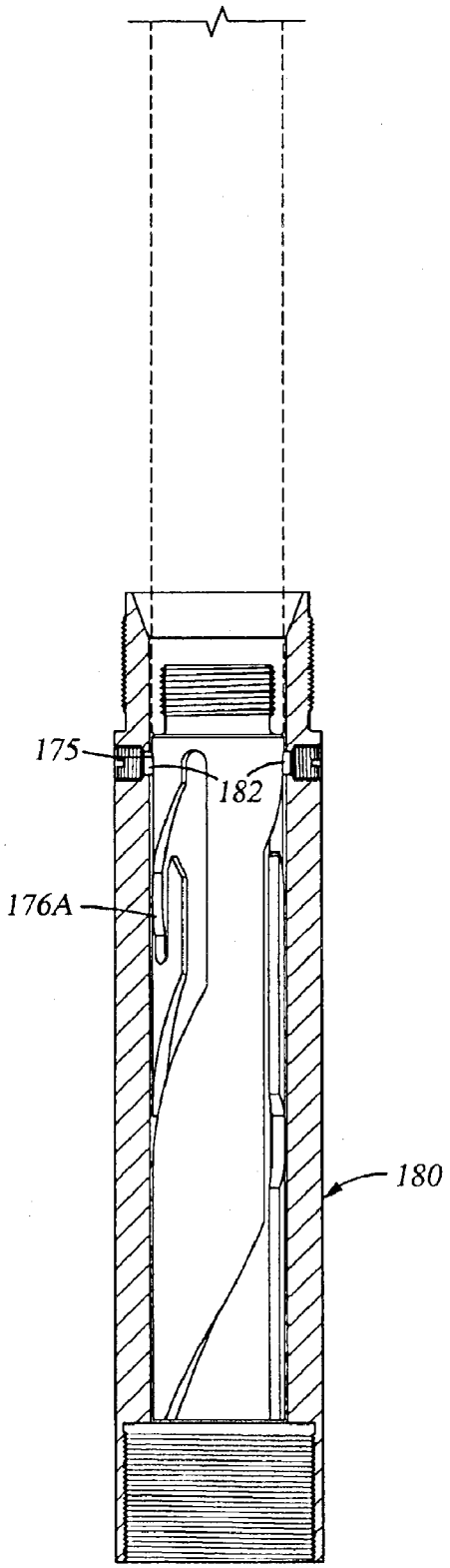
Figure 3D:
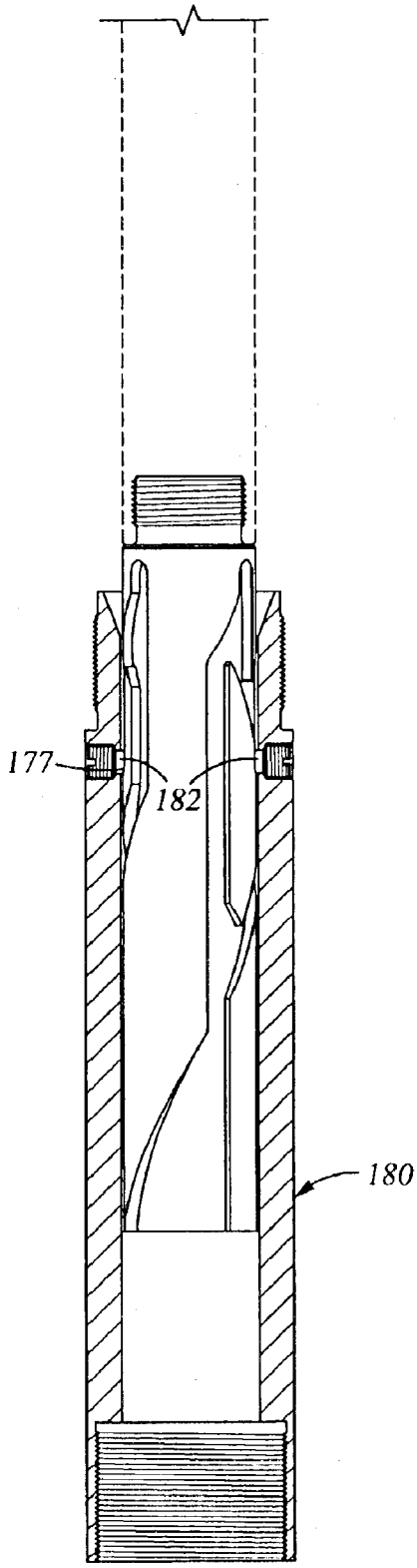
Figure 5:
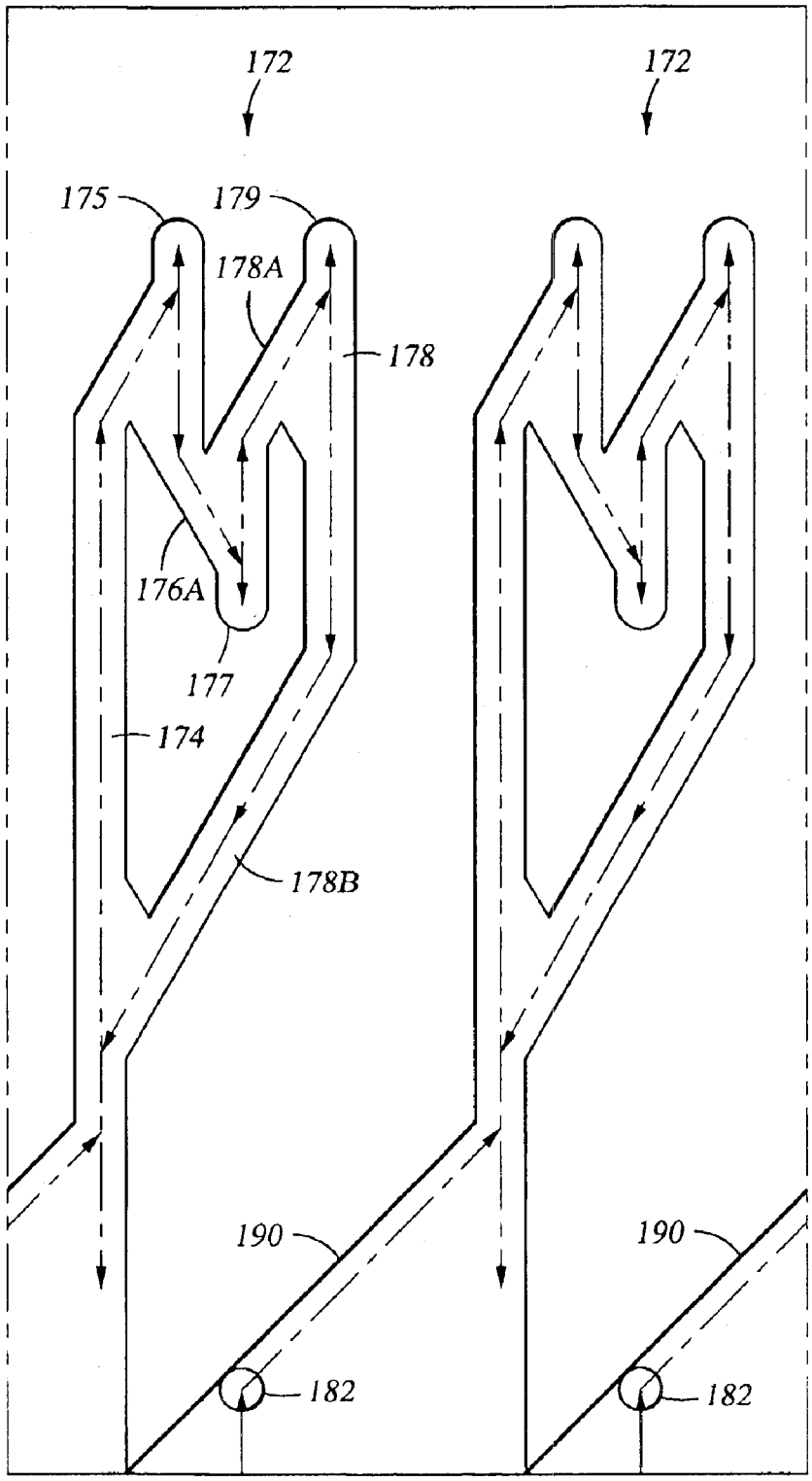
FIG. 5 is a surface layout view of a first latch component according to one embodiment of the invention.

FIGS. 3A–F are partially cross sectional side views of one embodiment of a latch assembly illustrating latching and unlatching operations. FIG. 5 is a surface layout view of a first latch component according to one embodiment of the invention. Referring to FIGS. 3A–F and 5, illustrations of the latching and unlatching operations are provided. To accomplish the latching and unlatching operations, the traveling valve cage 146 is lowered and raised by operators at the surface. To engage the first latch component 170 and the second latch component 180, the traveling valve cage 146 is lowered such that the pins 182 engage the cut-lip guides 190 as shown in FIG. 3A. As the traveling valve cage 146 is lowered further, the traveling valve cage 146 rotates in the direction as shown by arrow 310, and the pins 182 enter the entry groove 174, as shown in FIG. 3B. The traveling valve cage 146 is lowered until the pins contact against the first upper stop 175, as shown in FIG. 3C. When the traveling valve cage 146 has been lowered sufficiently such that the pins 182 are stopped in position against the first upper stop 175, the traveling valve cage 146 is ready to be raised or lifted to latch the traveling valve cage 146 to the pump housing 132. To latch the pump housing 132 and the traveling valve cage 146, the plunger 140 is raised until the pins 182 engages the locking stop 177, as shown in FIG. 3D. The pins 182 are urged into the locking stop 177 by the slanted catch surface 176A as the traveling valve cage 146 is raised. With the pins in the locking stop 177, the rod pump may be raised to the surface with the traveling valve cage 146 in a contracted down stroke position (or collapsed position) which substantially reduces the length of the lubricator required to remove the rod pump from the well.

Figure 3E:
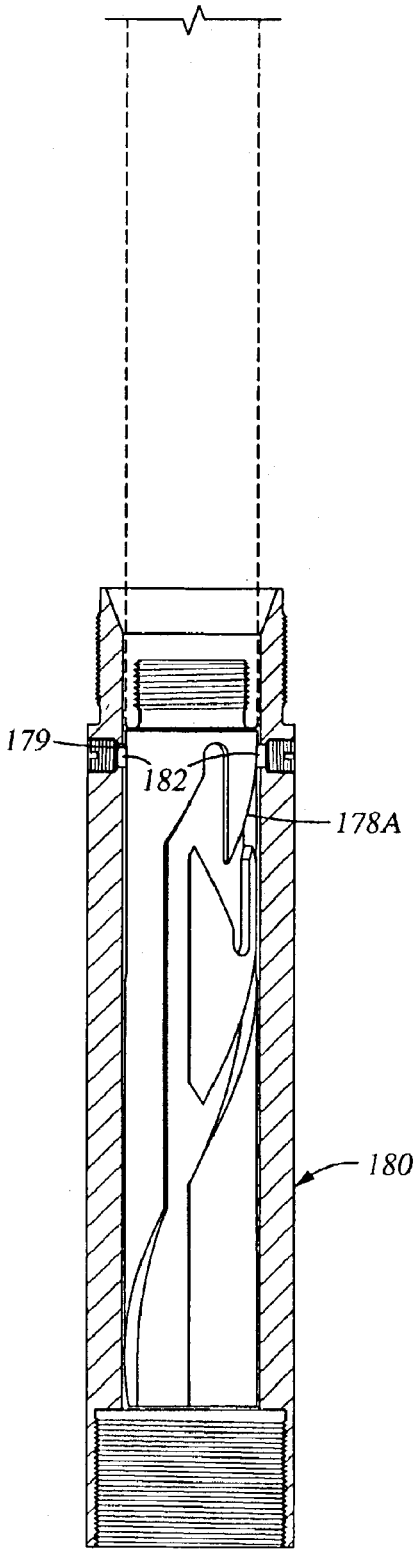
Figure 3F:
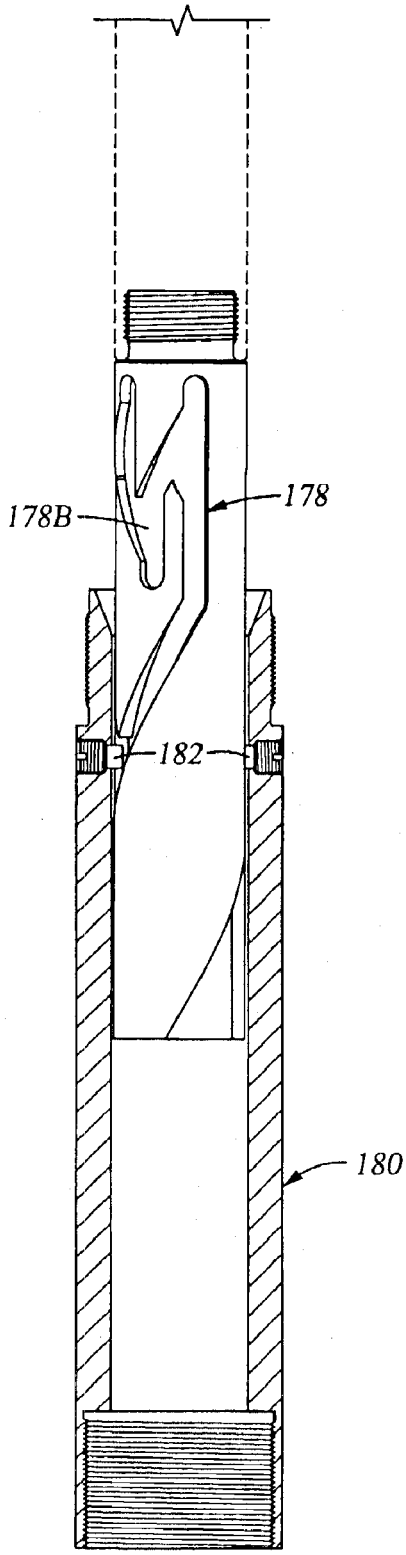

FIGS. 3E and 3F illustrate an unlatching operation. The traveling valve cage 146 may need to be unlatched from the pump housing 132 because of unintended or mistaken engagement of the latch components 170, 180. To unlatch the traveling valve cage 146 from the pins 182 on the pump housing 132, the traveling valve cage 146 is lowered so that the pins 182 engage the second upper surface 178A and stops at the second upper stop 179. At this position, shown in FIG. 3E, the pins 182 enters the release groove 178, and the traveling valve cage 146 may be pulled up (free from pins 182 on the pump housing 132. As the traveling valve cage 146 is raised, shown in FIG. 3F, the pins 182 are guided by the exit portion 178B of the release groove 178 to disengage the traveling valve cage 146 from the pins 182 on the pump housing 132.

The latch assembly 160 facilitates removal of the positive displacement pump 130 (i.e., rod pump) from the production tubing with the pump in a collapsed position. With the traveling valve cage 146 latched onto the pins 182 on the pump housing 132, a shorter lubricator may be utilized to remove the rod pump, and potential problems in locating lubricators of sufficient length are substantially reduced.

Figure 4:
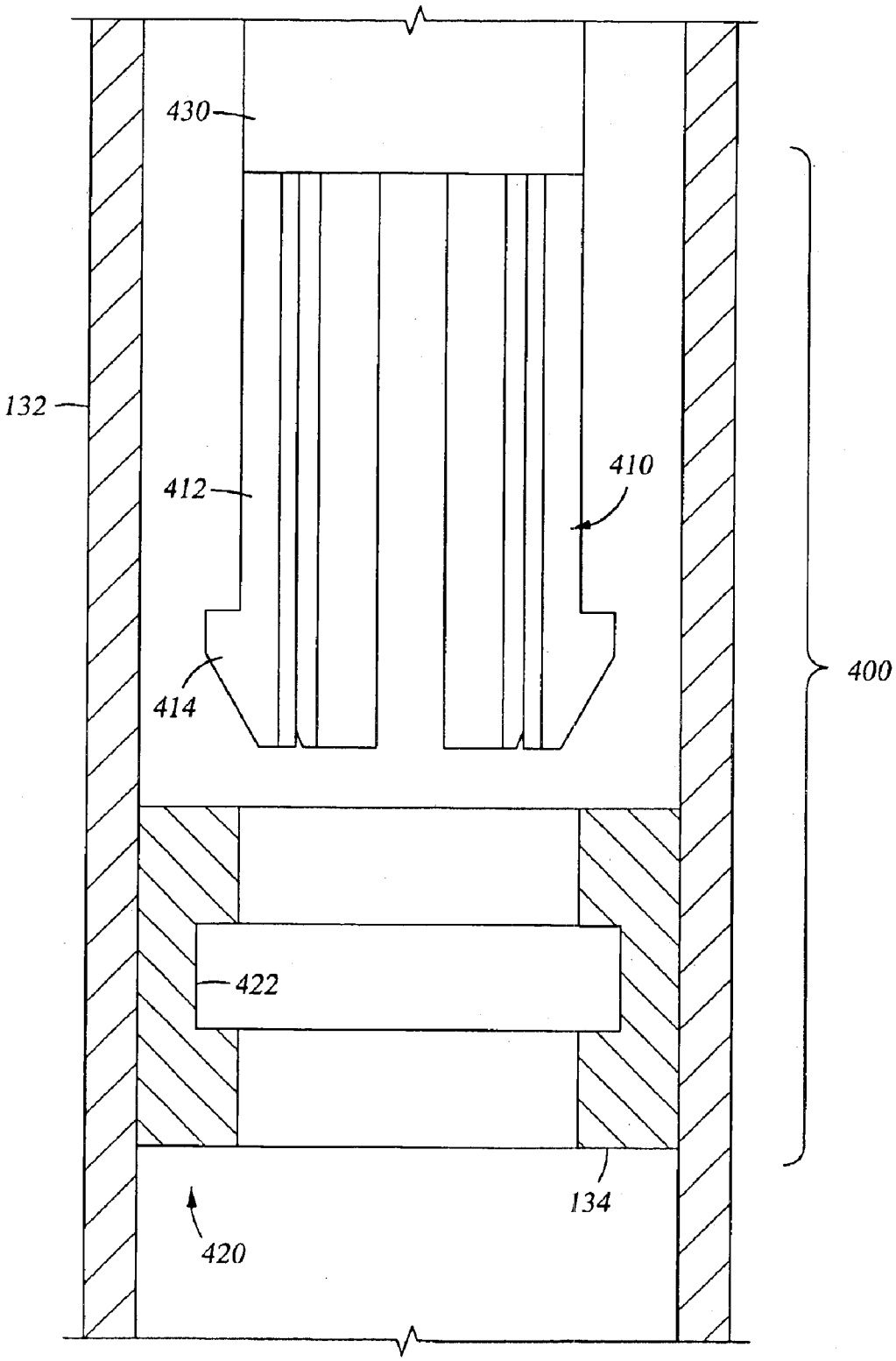
FIG. 4 is a partial cross sectional view of another embodiment of a latch assembly.

FIG. 4 is a partial cross sectional view of another embodiment of a latch assembly. In this embodiment, the latch assembly 400 comprises a collect 410 (first latch component) and a collet latch 420 (second latch component). The collet 410 is disposed on a plug 430 which is connected to the traveling valve cage 146. The collet 410 may comprise a plurality of flexible body portions 412 and clip ends 414. The collet latch 420 may be an annular groove 422 disposed on an interior surface of a bushing 134 disposed in the pump housing 132. Alternatively, the collet latch 420 may be an annular groove disposed on an interior surface of the pump housing 132. As another alternative, the collet may be disposed on bushing, and the collet latch may be disposed on the plug. During normal pumping operation, the collet 410 does not engage the collet latch 420. When the pump need to be retrieved for service, the traveling valve cage 146 is lowered so that the collet 410 engages the collet latch 420. As the traveling valve cage 146 is lowered, the flexible body portions 412 of the collet 410 are bent inwardly until the clip ends 414 snaps into the annular groove 422 of the collet latch 420. With the collet 410 latched into the collet latch 420, the rod pump may be retrieved in the collapsed position.

While the foregoing is directed to embodiments of the present invention, other and further embodiments of the invention may be devised without departing from the basic scope thereof, and the scope thereof is determined by the claims that follow.

What is claimed is:

1. A rod pump for lifting fluids from a wellbore, comprising:

a traveling valve cage attachable to a rod string, the traveling valve cage having a first latch component operatively connected thereto; and a pump housing having a second latch component operatively connected thereto, wherein the first latch component is disposable in latching engagement with the second latch component and wherein one of the first and second latch components includes one or more slanted surfaces for rotating the traveling valve cage into one or more stop positions as the traveling cage is moved axially in the pump housing.

2. The rod pump of claim 1, wherein the pump housing includes a bushing having the second latch component.

3. The rod pump of claim 1, wherein the first latch component is disposed on a plug connected to a distal portion of the traveling valve cage.

4. The rod pump of claim 1, wherein the first latch component comprises a surface having a set of grooves and the second latch component comprises one or more pins.

5. The rod pump of claim 4, wherein the set of grooves define an entry groove and a locking groove.

6. The rod pump of claim 5, wherein the set of grooves further comprises a release groove.

7. The rod pump of claim 5, further comprising a cut-lip guide connected to the entry groove, wherein the cut lip guide comprises one or more slanted surfaces disposed substantially circumferentially around a distal portion of the first latch component.

8. A rod pump for lifting fluids from a wellbore, comprising:

a traveling valve cage attachable to a rod string, the traveling valve cage having a first latch component operatively connected thereto; and a pump housing having a second latch component operatively connected thereto, wherein the first latch component is disposable in latching engagement with the second latch component, wherein the first latch component comprises one or more pins, wherein the set of grooves define an entry groove and a locking groove, and wherein the entry groove includes a first portion substantially parallel to an axis of the traveling valve cage and a second slanted portion extending to a first upper stop.

9. The rod pump of claim 8, wherein the locking groove includes a first slanted catch surface extending to a locking stop, the slanted catch surface disposed below the first upper stop.

10. The rod pump of claim 9, wherein the set of grooves further comprises a release groove and wherein the release groove includes a second slanted surface extending to a second upper stop and an exit portion connecting from the second stop to the entry groove.

11. The rod pump of claim 1, wherein the first latch component is disposable in releasable engagement with the second latch component.

12. A rod pump for lifting fluids from a wellbore, comprising:

a traveling valve cage attachable to a rod string, the traveling valve cage having a first latch component operatively connected therto; and a pump housing having a second latch component operatively connected thereto, wherein the first latch component is disposable in latching engagement with the second latch component, wherein the first latch component comprises a collet having a plurality of flexible body portions and a plurality of clip ends and the second latch component comprises a collet latch.

13. A reciprocating lift system, comprising:

a surface pumping unit;

a rod string disposed in connection with the surface pumping unit; and a pump disposed in connection with the rod string, the pump comprising:

a traveling valve cage attachable to the rod string, the traveling valve cage having a first latch component operatively connected thereto; and a pump housing having a second latch component operatively connected thereto, wherein the first latch component is disposable in latching engagement with the second latch component and wherein one of the first and second latch components includes one or more slanted surfaces for rotating the traveling valve cage into one or more stop positions as the traveling cage is moved axially in the pump housing.

14. The reciprocating lift system of claim 13, wherein the pump housing includes a bushing having the second latch component.

15. The reciprocating lift system of claim 13, wherein the first latch component is disposed on a plug connected to a distal portion of the traveling valve cage.

16. The reciprocating lift system of claim 13, wherein the first latch component comprises a surface having a set of grooves defining an entry groove and a locking groove and the second latch component comprises one or more pins.

17. The reciprocating lift system of claim 16, wherein the one or more slanted surfaces include a first upper slanted surface connecting the entry groove to a first upper stop and a slanted catch surface disposed below the first upper stop connected to a locking stop.

18. The reciprocating lift system of claim 17, wherein the set of grooves further comprises a release groove and wherein the one or more slanted surfaces includes a second upper slanted surface disposed above the locking stop connected to a second upper stop, which is connected to the release groove.

19. The reciprocating lift system of claim 16, further comprising a cut-lip guide connected to the entry groove, wherein the cut lip guide comprises one or more slanted surfaces disposed substantially circumferentially around a distal portion of the first latch component.

20. A reciprocating lift system, comprising:

a surface pumping unit;

a rod string disposed in connection with the surface pumping unit; and a pump disposed in connection with the rod string, the pump comprising:

a traveling valve cage attachable to the rod string, the traveling valve cage having a first latch component operatively connected thereto; and a pump housing having a second latch component operatively connected thereto, wherein the first latch component is disposable in latching engagement with the second latch component, wherein the first latch component comprises a surface having a set of grooves and the second latch component comprises one or more pins, wherein the set of grooves define an entry groove and a locking groove, and wherein the entry groove includes a first portion substantially parallel to an axis of the traveling valve cage and a second slanted portion extending to a first upper stop.

21. The reciprocating lift system of claim 20, wherein the locking groove includes a first slanted catch surface extending to a locking stop, the slanted catch surface disposed below the first upper stop.

22. The reciprocating lift system of claim 21, wherein the set of grooves further comprises a release groove and wherein the release groove includes a second slanted surface extending to a second upper stop and an exit portion connecting from the second stop to the entry groove.

23. The reciprocating lift system of claim 13, wherein the first latch component is disposable in releasable engagement with the second latch component.

24. A latch assembly for a rod pump, comprising:

a first latch component operatively connected to a traveling valve of the rod pump; and a second latch component operatively connected to a pump housing of the rod pump, wherein the first latch component is disposable in latching engagement with the second latch component and wherein one of the first and second latch components includes one or more slanted surfaces for rotating the traveling valve cage into one or more stop positions as the traveling cage is moved axially in the pump housing.

25. The latch assembly of claim 24, wherein the pump housing includes a bushing having the second latch component.

26. The latch assembly of claim 24, wherein the first latch component is disposed on a plug connected to a distal portion of the traveling valve cage.

27. The latch assembly of claim 24, wherein the first latch component comprises a surface having a set of grooves defining an entry groove and a locking groove and the second latch component comprises one or more pins.

28. The latch assembly of claim 27, wherein the one or more slanted surfaces include a first upper slanted surface connecting the entry groove to a first upper stop and a slanted catch surface disposed below the first upper stop connected to a locking stop.

29. The latch assembly of claim 28, wherein the set of grooves further comprises a release groove and wherein the one or more slanted surfaces includes a second upper slanted surface disposed above the locking stop connected to a second upper stop, which is connected to the release groove.

30. The latch assembly of claim 28, further comprising a cut-lip guide connected to the entry groove, wherein the cut lip guide comprises one or more slanted surfaces disposed substantially circumferentially around a distal portion of the first latch component.

31. The latch assembly of claim 24, wherein the first latch component is disposable in releasable engagement with the second latch component.

32. A pump for lifting fluids from a wellbore comprising:

a movable portion being movable in relation to a stationary portion, the movable portion having a first latch member and the stationary portion having a second latch member, wherein the first latch member disposable in engagement with the second latch member to limit relative movement between the movable portion and the stationary portion and wherein one of the first and second latch members includes one or more slanted surfaces for rotating the movable portion into one or more stop positions as the movable portion is moved axially in relation to the stationary portion.

33. The pump of claim 32, wherein the movable portion comprises a traveling valve cage.

34. The pump of claim 33, wherein the traveling valve cage includes a plug having the first latch member.

35. The pump of claim 32, wherein the stationary portion comprises a pump housing.

36. The pump of claim 35, wherein the pump housing includes a bushing having the second latch member.

37. The pump of claim 32, wherein the first latch member comprises a surface having a set of grooves defining an entry groove and a locking groove and the second latch member comprises one or more pins.

38. The pump of claim 32, wherein the first latch member is disposable in releasable engagement with the second latch member.

39. The pump of claim 37, wherein the one or more slanted surfaces include a first upper slanted surface connecting the entry groove to a first upper stop and a slanted catch surface disposed below the first upper stop connected to a locking stop.

40. The latch assembly of claim 39, wherein the set of grooves further comprises a release groove and wherein the one or more slanted surfaces includes a second upper slanted surface disposed above the locking stop connected to a second upper stop, which is connected to the release groove.

41. The latch assembly of claim 40, further comprising a cut-lip guide connected to the entry groove, wherein the cut lip guide comprises one or more slanted surfaces disposed substantially circumferentially around a distal portion of the first latch component.

42. A method for operating a rod pump, comprising:

lowering a traveling valve cage attachable to a rod string to engage a first latch component operatively connected the traveling valve cage against a second latch component operatively connected to a pump housing; and moving the traveling valve cage axially in the pump housing, whereby the traveling valve cage is rotated into one or more stop positions by the axial movement.

43. The method of claim 42, wherein the one or more stop positions include a first upper stop position which indicates engagement of the first and second latch components, a locking stop position which allows retrieval of the traveling valve cage and the pump housing in a contracted position and a second upper stop position which facilitates release of the first and second latch components from engagement.

* * * * *

UNITED STATES PATENT AND TRADEMARK OFFICE

CERTIFICATE OF CORRECTION

PATENT NO. : 6,883,612 B2
APPLICATION NO. : 10/347132
DATED : April 26, 2005
INVENTOR(S) : Joel Ferguson, Doug Verner and Brian Waterhouse It is certified that error appears in the above-identified patent and that said Letters Patent is hereby corrected as shown below:

Column 7, Claim 8, Line 17: After "comprises", insert --a surface having a set of grooves and the second latch component comprises--

Signed and Sealed this

Fifth Day of December, 2006

JON W. DUDAS
*Director of the United States Patent and Trademark Office*